US008117687B2

(12) United States Patent
Le et al.

(10) Patent No.: US 8,117,687 B2
(45) Date of Patent: Feb. 21, 2012

(54) DIVERTER VALVE WITH MINIMUM BIAS FORCES

(75) Inventors: Tuan Le, Diamond Bar, CA (US); Robert Collin, Lake Forest, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 445 days.

(21) Appl. No.: 12/538,740

(22) Filed: Aug. 10, 2009

(65) Prior Publication Data

US 2010/0043131 A1 Feb. 25, 2010

Related U.S. Application Data

(60) Provisional application No. 61/087,929, filed on Aug. 11, 2008.

(51) Int. Cl.
*E03D 1/14* (2006.01)
*E03D 3/12* (2006.01)

(52) U.S. Cl. ..... 4/324; 4/325; 4/366; 4/410

(58) Field of Classification Search ..... 4/324, 325, 4/366, 410; 137/436
See application file for complete search history.

(56) References Cited

U.S. PATENT DOCUMENTS

| | | | | |
|---|---|---|---|---|
| 4,408,361 | A * | 10/1983 | Rozek | 137/436 |
| 5,584,080 | A | 12/1996 | Nichols-Roy et al. | |
| 5,659,903 | A * | 8/1997 | Hammarstedt | 4/325 |
| 5,873,136 | A | 2/1999 | Geeham | |
| 6,163,897 | A * | 12/2000 | Plas et al. | 4/410 |
| 6,442,772 | B2 * | 9/2002 | Han et al. | 4/325 |

OTHER PUBLICATIONS

PCT International Search Report, Sep. 25, 2009.

* cited by examiner

*Primary Examiner* — Tuan Nguyen
(74) *Attorney, Agent, or Firm* — Gordon & Rees, LLP

(57) ABSTRACT

A diverter valve including: an inlet port coupled to a refill tube; a first outlet port; a bowl refill tube coupled to the outlet port with its second end adjacent to a toilet tank overflow tube; a second outlet port; a central flow passageway providing a path of fluid communication between the inlet port and the first and second outlet ports, the entrance of the first outlet port and the entrance of the second outlet port being directly opposite one another in the central flow passageway; a poppet in the central flow passageway, the poppet having a raised position obstructing the first outlet port and a lowered position obstructing the second outlet port; an actuating arm, float member and rod coupled to the poppet, wherein movement of the float member translates downward motion of the rod into upward motion of the actuating arm and vice versa.

9 Claims, 8 Drawing Sheets

DIVERTER VALVE WITH MINIMUM BIAS FORCES

CROSS-REFERENCE TO RELATED APPLICATIONS

The present application claims priority to provisional patent application Ser. No. 61/087,929 filed Aug. 11, 2008, entitled "Diverter Valve With Minimum Bias Forces," which is incorporated by reference into the instant application as if set forth verbatim.

FIELD OF THE INVENTION

The present invention relates generally to toilet tank refill valves, and in one aspect to a toilet tank refill valve for a dual flush toilet.

BACKGROUND OF THE INVENTION

Conventional toilets generally have a flush valve that is manually actuated by a user, which when opened causes a predetermined amount of water to flow from toilet tank into the toilet bowl, thereby initiating a flush of the toilet bowl. In conventional toilets, the size of the flush (i.e. the volume of water that flows into the bowl from the tank) is constant. The tank includes a refill valve which is used to refill both the toilet tank and the toilet bowl after the flush. The refill valve is typically controlled by a buoyant member such as a ballcock or float. When the water level in the tank drops during a flush, the float falls with the water level and opens the refill valve. The refill valve remains open until the tank is filled to a preset level, at which point the float causes the refill valve to turn off. A portion of the water provided by the refill valve is generally diverted into an overflow tube, and is used to refill the bowl after a flush. Thus, in a conventional toilet, the refill valve must be calibrated so that the bowl refills to the proper level in the time it takes for the tank refill to the preset level.

In recent years, dual flush toilets have become more popular. As used herein, the term "dual flush toilet" means a toilet with two different flush sizes—a partial flush for disposal of liquid waste, and a full flush for disposal of solid waste. The full flush uses approximately the same volume of water as the flush in a conventional toilet. The partial flush uses less water, in some cases approximately half as much as the full flush. However, the different flush sizes in a dual flush toilet creates difficulties for refilling the bowl after a flush. Because the partial flush uses less water, the water level in the tank does not fall as far as it does in a full flush. Thus, the tank fills up faster after a partial flush than after a full flush. In other words, the refill valve is open for less time after a partial flush than after a full flush. However, the bowl is equally empty after both partial flushes and full flushes. The problem that thus arises is that bowl must be refilled to the same level after both partial flushes and full flushes, even though the refill valve is open for different durations of times depending on the flush that just occurred.

Further, in siphonic toilets commonly found in the U.S., it is important to refill the bowl to the correct level after a flush. If the water level in the bowl is too low, it may not block sewage gasses from entering the room from the sewer. If the water level in the bowl is too high, then water is wasted. Since the main purpose of dual flush toilets is to conserve water, simply calibrating the toilet to fill to the correct level after a partial flush is not a satisfactory solution because then the bowl would be overfilled after a full flush (since the refill valve is open longer after a full flush). Similarly, simply calibrating the toilet to fill to the correct level after a full flush is not a solution because then the bowl would be underfilled after a partial flush (since the refill valve is open less time after a partial flush), potentially allowing sewage gasses into the room.

Accordingly, there is a need for a device that refills the toilet bowl to the same level after both partial flushes and full flushes in a dual flush toilet. It is also desirable that such a device has minimum components and is easy to operate.

SUMMARY OF THE INVENTION

The present invention provides a diverter valve that may optionally be used for a dual flush toilet. The present diverter valve has an inlet port coupled to a refill tube for receiving refill water and a first outlet port with an entrance and an exit. A bowl refill tube has a first end coupled to the exit of the first outlet port and a second end adjacent to a toilet tank overflow tube. The bowl refill tube provides a path of fluid communication between the first outlet port and the toilet tank overflow tube. The diverter valve also has a second outlet port with an entrance and an exit. A central flow passageway provides a path of fluid communication between the inlet port and the first and second outlet ports. The entrance of the first outlet port and the entrance of the second outlet port are directly opposite one another in the central flow passageway. A poppet is slidably mounted in the central flow passageway and is movable between a first raised position obstructing the entrance of the first outlet port and a second lowered position obstructing the entrance of the second outlet port. An actuating arm is coupled to the poppet. The diverter valve also includes a float member coupled to a rod and movable between a raised position and a lowered position. A pivoting linkage has a first end coupled to the rod and a second end coupled to the actuating arm. The pivoting linkage translates downward motion of the rod into upward motion of the actuating arm and translates upward motion of the rod into downward motion of the actuating arm. When water level in a toilet tank in which the diverter valve is mounted falls below a first predetermined level, the float member is in the lowered position and the poppet is in the first raised position obstructing the entrance of the first outlet port and preventing flow of refill water through the first outlet port into the bowl refill tube. When water level in the toilet tank rises above the first predetermined level, the float member is in the raised position and the poppet is in the second lowered position obstructing the entrance of the second outlet port and permitting flow of refill water through the first outlet port into the bowl refill tube.

The poppet may optionally have a saucer-shaped head with a convex upper surface for obstructing the entrance to the first outlet port and a convex lower surface for obstructing the entrance to the second outlet port. These convex upper and lower surfaces may be substantially conical.

The inlet port and the first outlet port may be integrally formed in an upper housing member that forms an upper wall of the central flow passageway. The second outlet port may be integrally formed in a lower housing member that forms a lower wall of the central flow passageway. The lower housing member may optionally be a portion of a bracket attached to a tower flush valve. This bracket may have two parallel spaced apart flanges each having an opening. The pivoting linkage may have opposing pins rotatably engaged within the openings of the spaced apart flanges.

The rod coupled to the float member may be a rail upon which the float member is slidably mounted. The rail may have a plurality of spaced apart protrusions and the float member may include a sliding flange that can engage with these spaced apart protrusions to fix the float member in place relative to the rail.

In operation, the present diverter valve diverts water flow from a fill valve in a water tank such that the toilet bowl can be refilled to the same level after both partial flushes and full flushes in a dual flush toilet. It is to be understood, however, that the present diverter valve may be used in applications other than dual flush toilets.

A first advantage of the present diverter valve is that it is simple and compact, and operates very easily with minimal components.

A second advantage of the present diverter valve is that the slidable poppet may be moved between its raised and lowered positions with only a minimum amount of effort. Specifically, in one embodiment, the unique saucer-shaped dimensions of the poppet ensure that only minimum forces are required to lift it to its raised position or to drop it to its lowered position. As a result, the present diverter valve directs fluid from an inlet valve to one of two outlets with only minimum activated or bias force being required.

For example, in one preferred aspect, the top conical shape of the poppet provides lift as water passes thereover. Thus, when the poppet is slightly raised (i.e.: positioned slightly away from sealing the entrance to the second outlet), the upward force from the water flow passing thereover can assist in pulling the poppet upward with minimal effort required. Only a small external force is thus required to overcome the weight of the poppet and keep it in its raised position. If this small external force is removed, the weight of the poppet (along with another small external force) will disengage the poppet from its raised position, and move it downward.

The preferred unique geometry of the poppet (i.e.: having upper and lower saucer-shaped conical surfaces) causes the water pressure exerted on both sides of the poppet to be almost equal (when the poppet is disposed mid-way between its raised and lowered positions). Thus, only minimal effort is required to slidably move the poppet in either direction. As a result, movement of a small buoyant weight cup in the tank can be used to activate the activation lever. As only minimal forces are required to activate the diverter valve, this buoyant weight cup can be relatively small, and fit within the frame of a tower flush valve.

In addition, the uniquely shaped upper and lower surfaces of the poppet cleanly seal against the first and second outlet ports, respectively. Water back pressure in the valve chamber can also assist in holding the poppet in its lowered position (sealing the mouth of the second outlet port).

BRIEF DESCRIPTION OF THE DRAWINGS

These and other features of the invention are described in further detail in the following description and will be better understood with reference to the accompanying drawings, which are briefly described below.

DETAILED DESCRIPTION

Exemplary embodiments of the invention are described in detail below with reference to the appended figures, wherein like elements are referenced with like numerals throughout. The figures are not necessarily drawn to scale and do not necessarily show every detail or structure of the various embodiments of the invention, but rather illustrate exemplary embodiments and mechanical features in order to provide an enabling description of such embodiments.

Various modifications and alterations of the invention will become apparent to those skilled in the art without departing from the spirit and scope of the invention, which is defined by the accompanying claims. For example, it should be noted that steps recited in any method claims below do not necessarily need to be performed in the order they are recited. For example, in certain embodiments, steps may be performed simultaneously. The accompanying claims should be constructed with these principles in mind.

Any element in a claim that does not explicitly state "means for" performing a specified function or "step for" performing a specified function is not to be interpreted as a "means" or "step" clause as specified in 35 U.S.C. §112, ¶6.

Figure 1A:
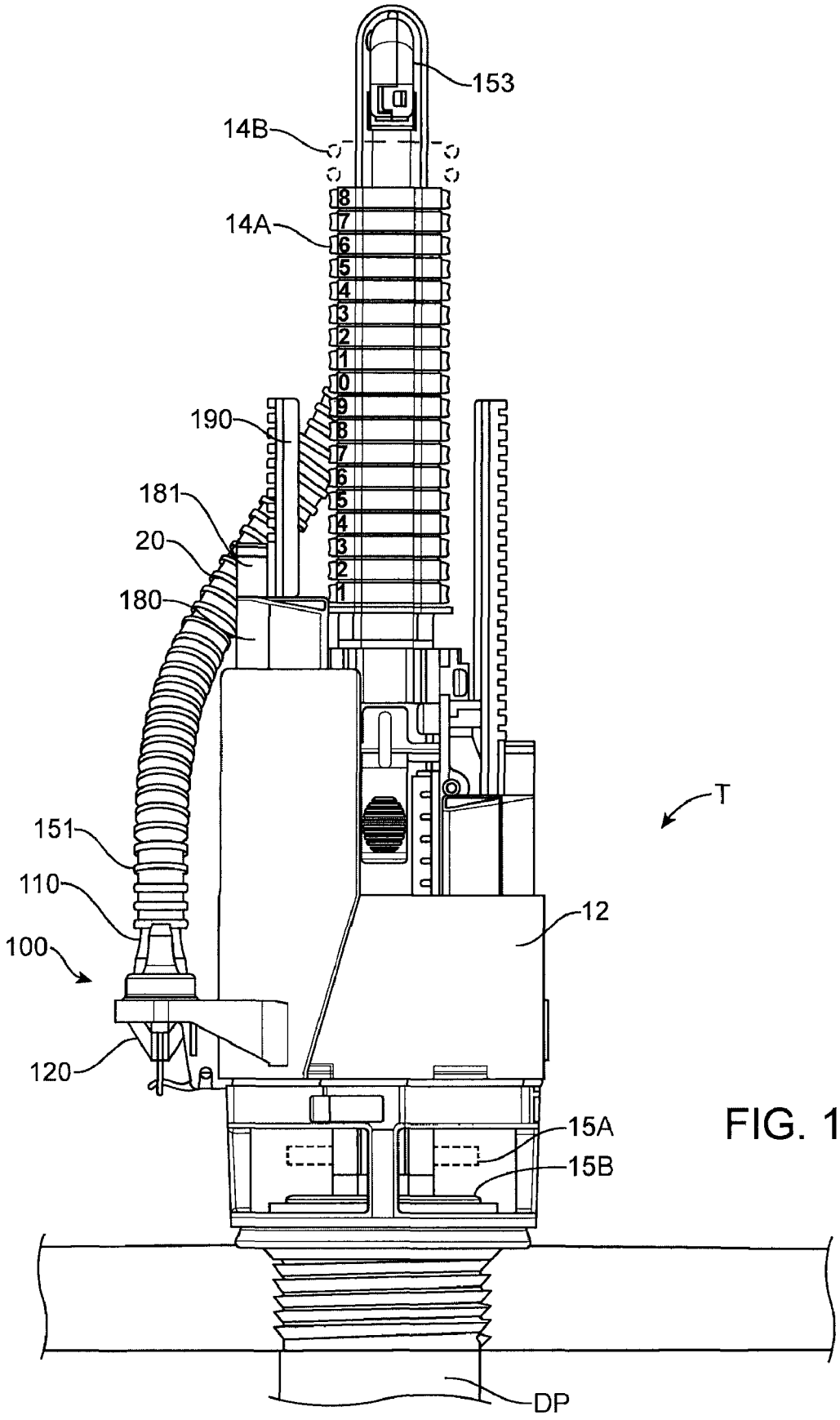
FIG. 1A is a front elevation view of a tower flush valve with the present diverter valve extending therefrom.
Figure 1B:
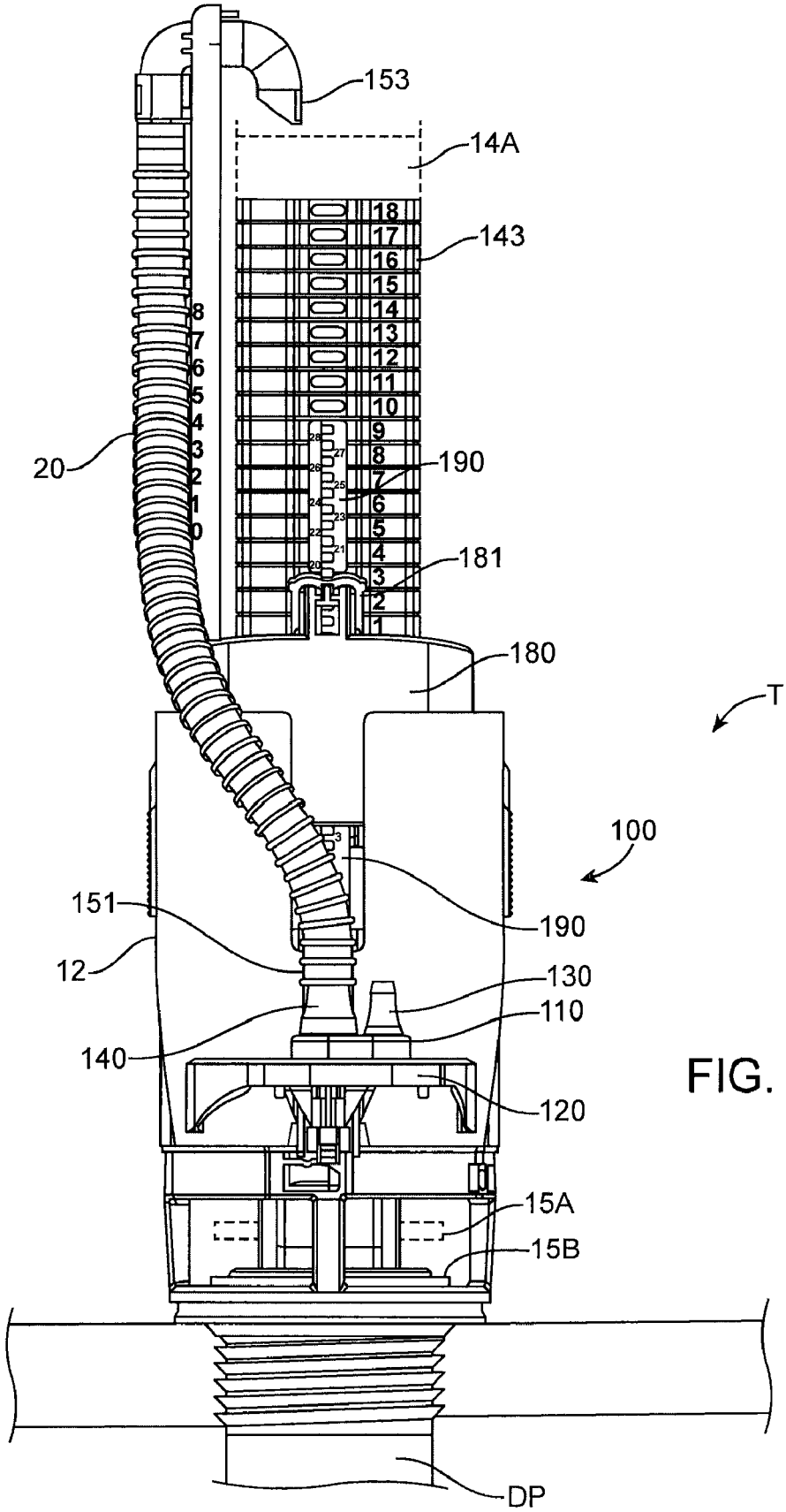
FIG. 1B is a side elevation view corresponding to FIG. 1A.
Figure 2:
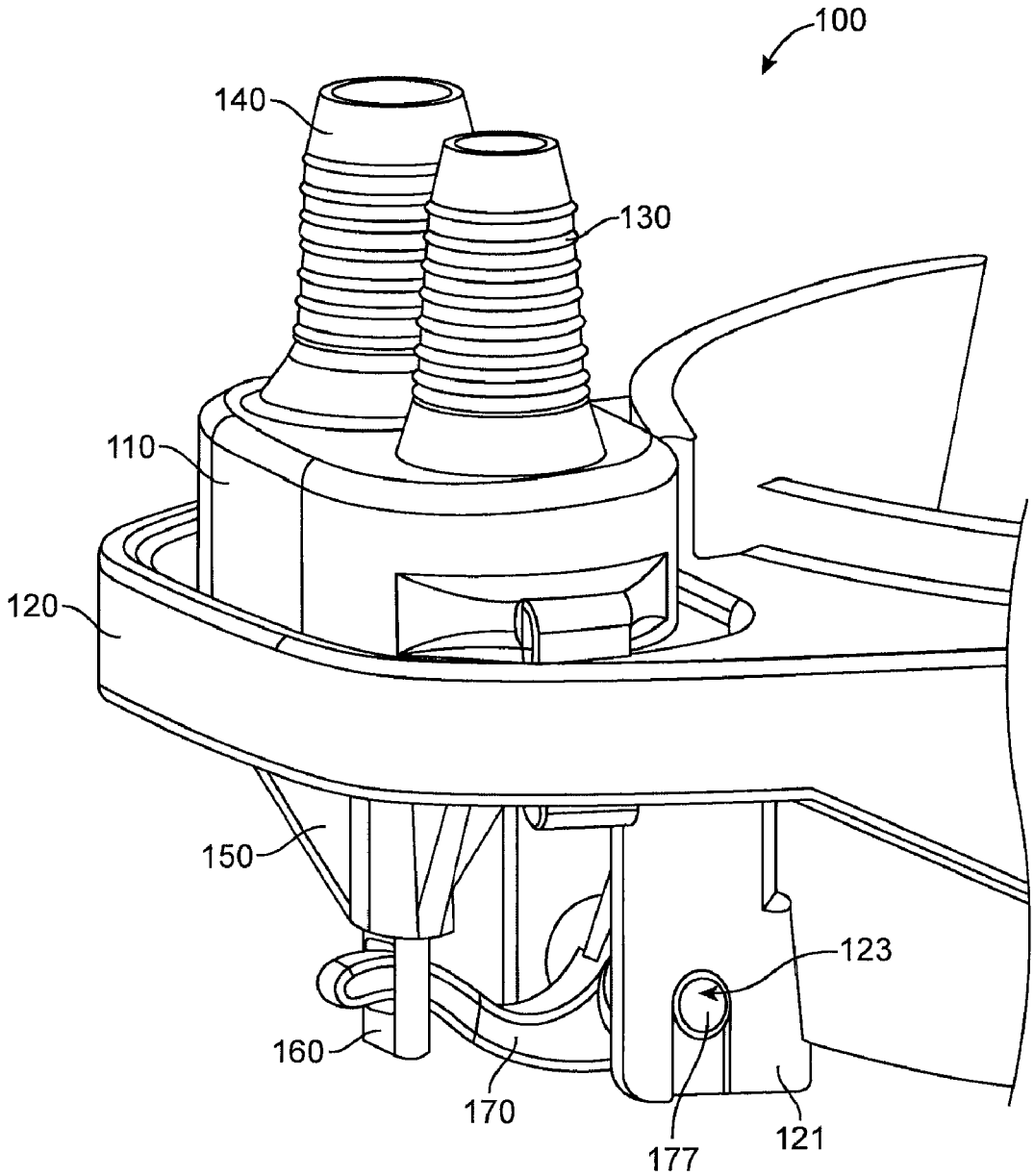
FIG. 2 is a close up perspective view of the present diverter valve.
Figure 3:
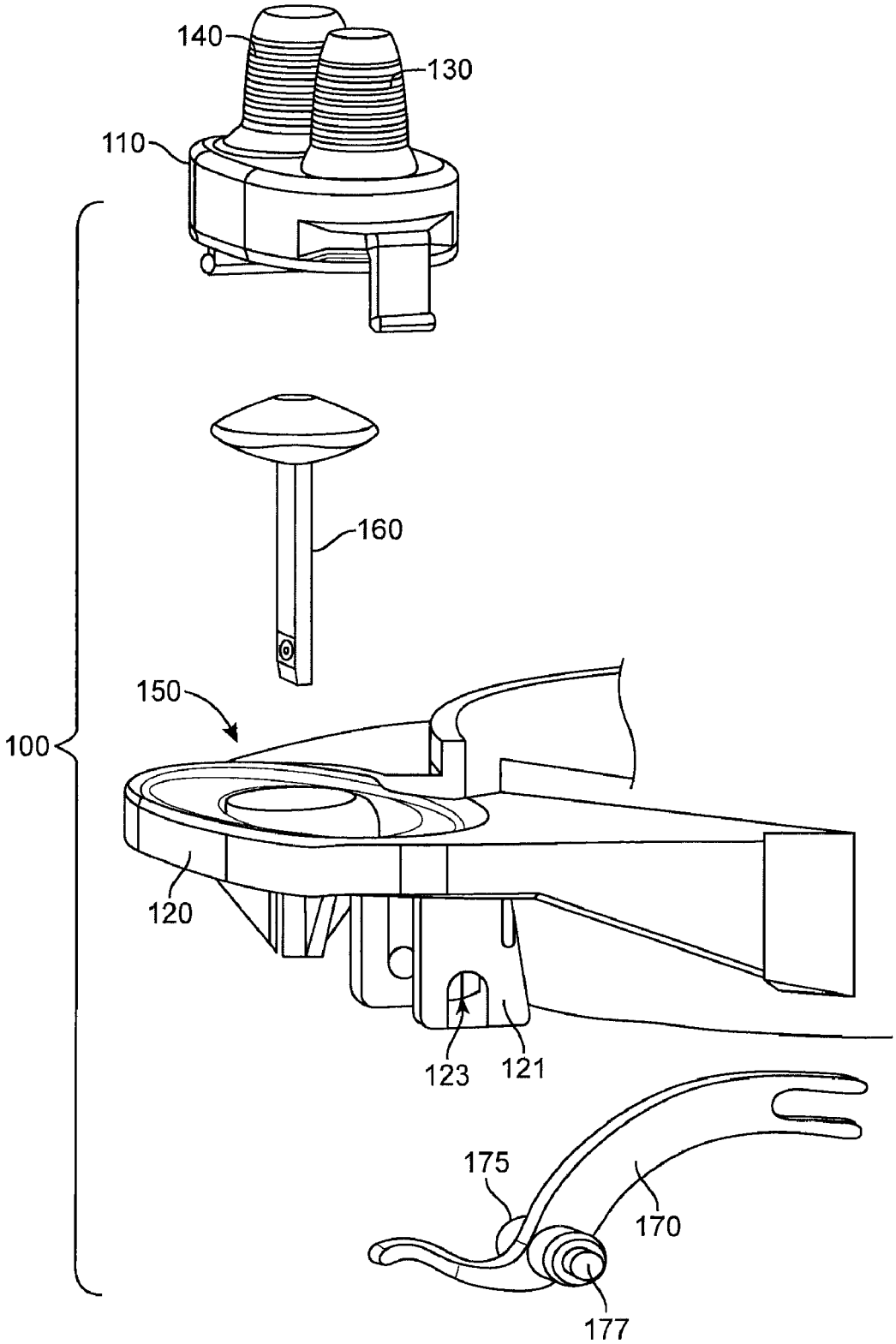
FIG. 3 is an exploded view corresponding to FIG. 2.

Referring first to FIGS. 1A and 1B, a tower flush valve 10 with integral diverter valve 100 is provided. Tower flush valve 10 comprises a tower frame member 12 that is mounted in a toilet tank T above a drain pipe opening DP of toilet tank T. An overflow tube 14 is mounted within a housing slidable between a raised position 14A and a lowered position 14B. The overflow tube 14 comprises a flange 15 at its lower end that seals drain pipe opening DP when overflow tube 14 is in its lowered position (14B).

In operation, when the toilet is flushed, overflow tube 14 is raised to position 14A (shown in dotted lines), lifting flange 15 to position 15A (shown in dotted lines) and permitting water from tank T to flow past flange through drain pipe opening DP and into the toilet bowl. After the flush, overflow tube 14 drops to position 14B, causing flange 15 to re-seal drain pipe opening DP. At this time, the tank T begins to refill with water. As will be fully explained below, a portion of the water will be diverted into overflow tube 14 by novel diverter valve 100. Overflow tube 14 is hollow. As such, the water diverted through overflow tube 14 will pass directly into the toilet bowl, thereby refilling the toilet bowl after the flush.

Referring next to FIGS. 2 to 7, further details of diverter valve 100 are shown as follows. Diverter valve 100 comprises an upper housing 110 and a lower housing 120. Together, upper housing 110 forms the upper wall of a central flow passageway 125 and lower housing 120 forms the lower wall of a central flow passageway 125.

Upper housing preferably 110 comprises an integral inlet port 130 and first outlet port 140, with inlet port 130 coupled to a refill tube (not shown) for receiving refill water therein. First outlet port 140 has an entrance 141 and an exit 143. A bowl refill tube 20 has its first end 151 coupled to the exit of first outlet port 140 and a second end 153 adjacent to overflow tube 14. Thus, bowl refill tube 20 provides a path of fluid communication between first outlet port 140 and overflow tube 14.

Lower housing 120 may simply be a bracket integrally formed with tower frame member 12, with the bracket forming the lower wall of central flow passageway 125. Lower housing bracket 120 may comprise a second outlet port 150 having an entrance 151 and an exit 153. Thus, central flow passageway 125 provides a path of fluid communication between inlet port 120 and either of the first and second outlet ports 140 and 150, respectively. As can be clearly seen, entrance 141 of first outlet port 140 and entrance 151 of second outlet port 150 are preferably directly opposite to one another in central flow passageway 125.

Figure 4:
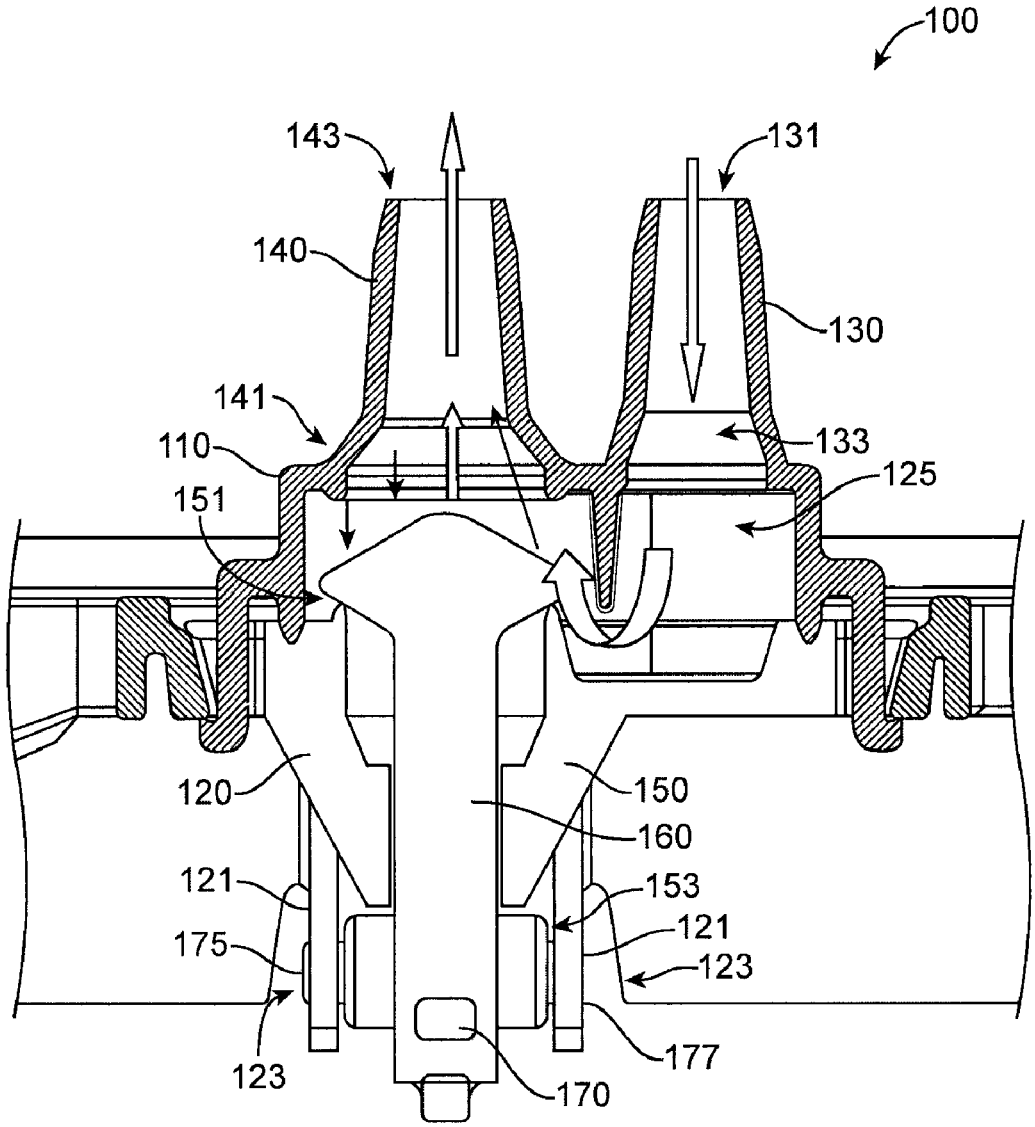
FIG. 4 is a sectional side elevation view of the diverter with the poppet in its lowered position.
Figure 5:
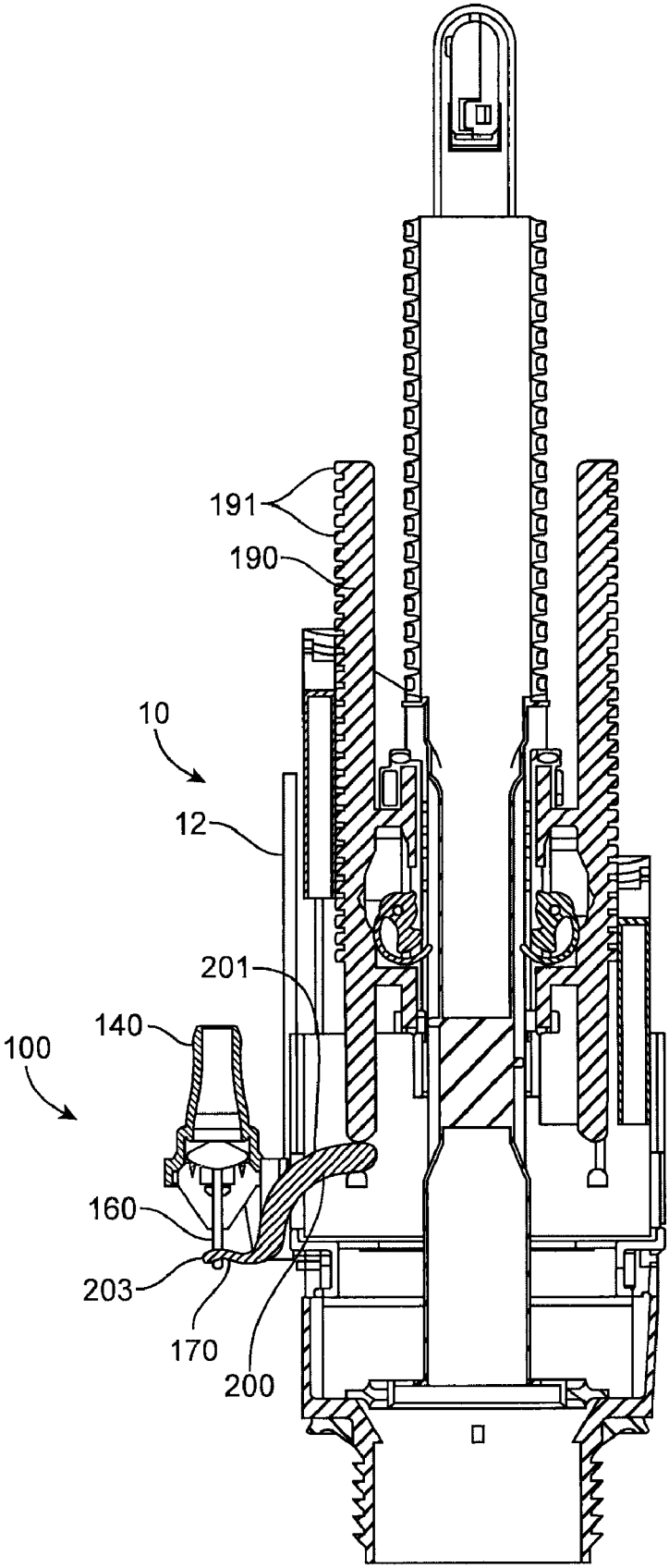
FIG. 5 is a side elevation cut away view of the tower flush valve showing the positions of the poppet, actuating arm, and float member when the poppet is in its lowered position of FIG. 4.
Figure 6:
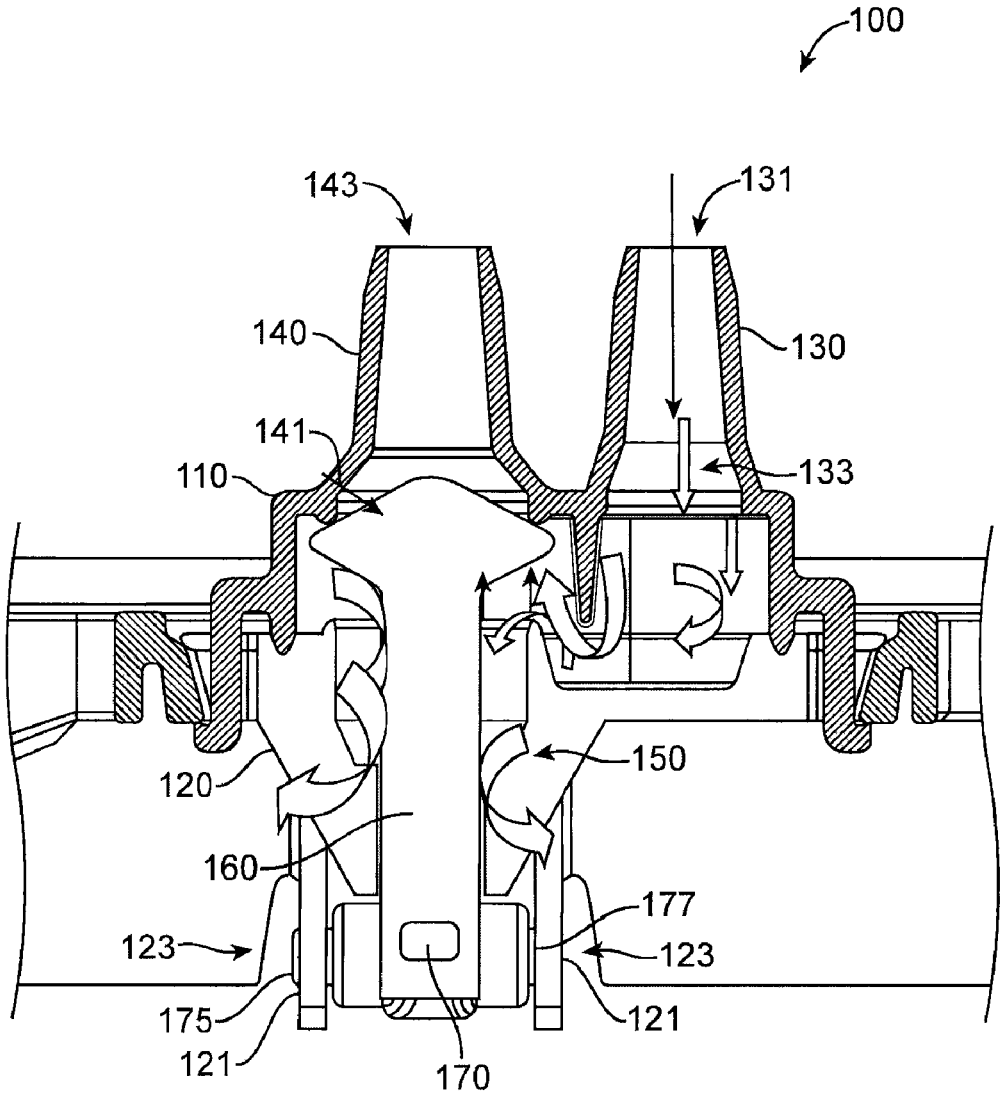
FIG. 6 is a sectional side elevation view of the diverter with the poppet in its raised position.
Figure 7:
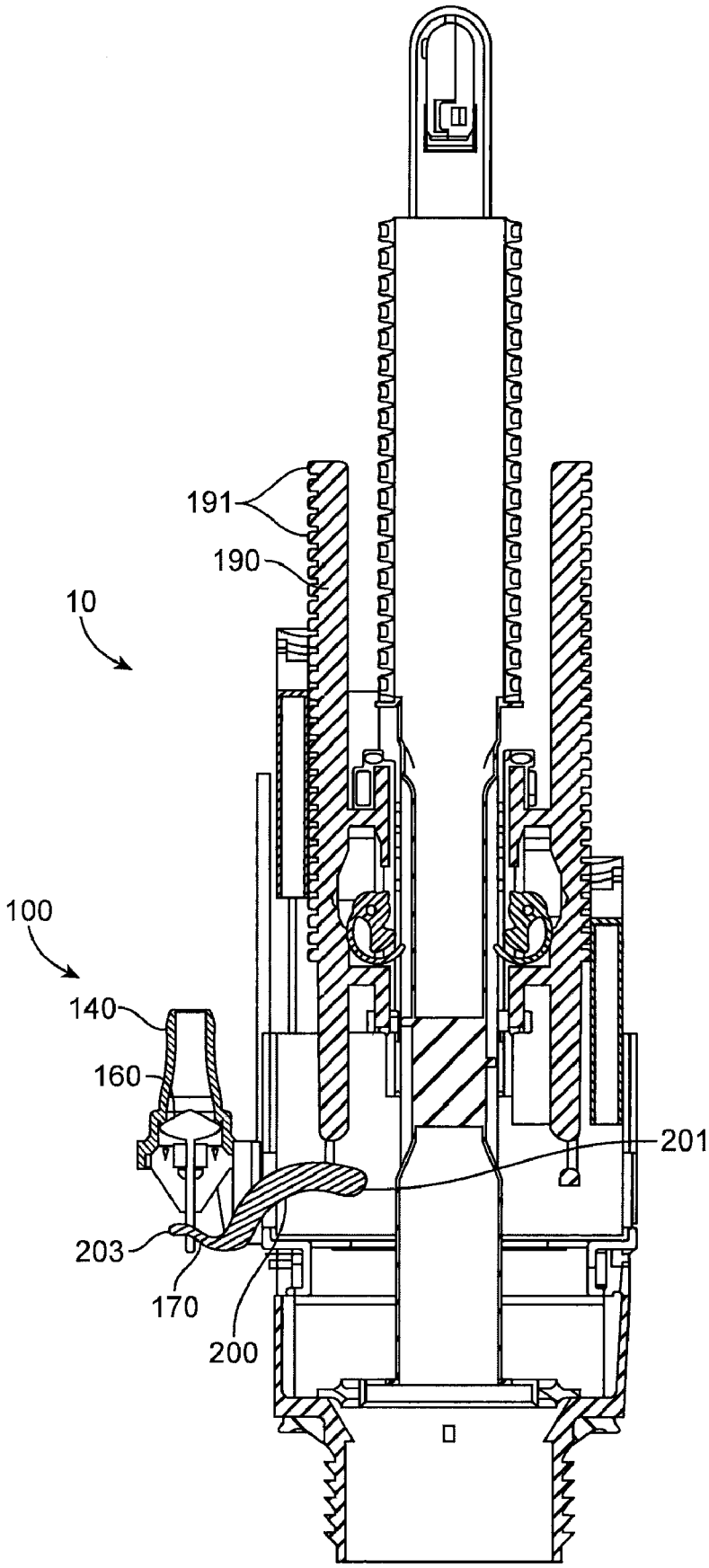
FIG. 7 is a is a side elevation cut away view of the tower flush valve showing the positions of the poppet, actuating arm, and float member when the poppet is in its raised position of FIG. 5.

As can also be seen (especially in FIGS. 4 and 6), a poppet 160 is slidably mounted to move up and down in central flow passageway 125. As seen in FIG. 6, poppet 160 has a first raised position obstructing the entrance 141 of first outlet port 140. As seen in FIG. 4, poppet 160 also has second lowered position obstructing the entrance 151 of second outlet port 150. As seen in FIGS. 5 and 7, an actuating arm 170 is coupled to poppet 160. A float member 180 is coupled to rod 190. As can also be seen in FIG. 1, float member 180 may be mounted within tower housing 10 and is movable between a raised position 180A and a lowered position 180B. Also provided is a pivoting linkage 200 having a first end 201 coupled to rod 190 and a second end 203 coupled to actuating arm 170. Pivoting linkage 190 translates downward motion of rod 190 into upward motion of actuating arm 170, and also translates upward motion of rod 190 into downward motion of actuating arm 170.

As a result, the vertical position of float member 180 controls the vertical position of poppet 160. Therefore, when the water level in the toilet tank falls below a first predetermined level, float member 180 will be is in the lowered position and poppet 160 will be in its raised position. This position will cause poppet 160 to obstruct entrance 141 of first outlet port 140 which will in turn prevent the flow of refill water through first outlet port 140 into the bowl refill tube 20.

Conversely, when the water level in the toilet tank rises above the first predetermined level, float member 180 will be in its raised position and poppet 160 will be in its lowered position. This position will cause poppet 160 to obstruct entrance 151 of second outlet port 150 which will in turn permit the flow of refill water through the first outlet port 140 into the bowl refill tube 150.

As can be seen, poppet 160 preferably comprises a saucer shaped head having a convex upper surface 161 for obstructing the entrance 141 to first outlet port 140 and a convex lower surface 163 for obstructing the entrance 151 to second outlet port 150. Convex surfaces 161 and 163 are preferably conical.

As illustrated, lower housing bracket 120 may comprise two parallel spaced apart flanges 121 each having an opening 123 therethrough. The pivoting linkage 170 may comprise opposing pins 175 and 177 rotatably engaged with openings 123 of the spaced apart flanges.

Rod 190 may simply be a rail upon which float member 180 is slidably mounted, with the rail comprising a plurality of spaced apart protrusions 191. Float member 180 may further comprise a sliding flange 181 that is engageable with spaced apart protrusions 191 on rail 190 to fix float member 180 in place relative to rail 190.

In operation, the toilet is flushed by a user turning or pushing a lever or handle, causing a cable or linkage connected thereto to move overflow tube 14 to raised position 14A. At this time, water then passes out though drain pipe opening DP and down into the toilet bowl. Consequently, the water level in tank T drops, causing float member 180 to drop to its lowered position 180B. This will in turn cause poppet 160 to rise and seal outlet 140, thereby opening refill water flow from inlet 110 through to outlet 150, passing directly into tank T. As the tank fills with water, float member 180 will then be lifted to its raised position 180A. This will in turn cause poppet 160 to drop to its lowered position, thereby instead diverting refill water flow from inlet 110 through to outlet 140, passing through bowl refill tube 20 and into overflow tube 14.

As a result, the toilet bowl is basically refilled during the time that the second (i.e.: upper) half of the tank is refilled. Thus, in the event of a half flush, (when the water level in the tank drops only partially), poppet 160 will remain positioned such that flow is directed into overflow tube 14. As a result, the tank and bowl are refilled at the same time. Conversely, in the event of a full flush, (when the water level in the tank drops fully), poppet 160 will first be lifted such that the refill water passes into the tank. When the tank has been half filled, float member 180 will then be lifted to its raised position causing poppet 160 to drop to its lowered position, diverting the flow of refill water into the overflow tube 14 to fill the bowl. At this time, both the upper half of the tank and the bowl itself are refilled.

In summary, the present system operates such that the toilet bowl only refills when the top half of the tank is refilling. Therefore, in the event of a half flush, the tank and bowl refill together. Conversely, in the event of a full flush, the bottom half of the tank is refilled, and then the top half of the tank is refilled together with the toilet bowl. As a result, the toilet bowl refilling is pre-calibrated to refill with the same amount of water regardless of whether the flush was a partial (i.e.: half) of full flush. In preferred aspects, the present diverter valve operates to divert refill water into the toilet bowl only after the tank has already been half refilled. Since the exact volume to refill a particular toilet bowl varies depending upon the geometry of the toilet bowl, the refilling system is pre-configured to deliver a particular volume of refill water for the duration of the half flush. As a result, the level of fluid in the bowl is refilled to the same level for both a full flush and a half flush.

What is claimed is:

1. A diverter valve comprising:

an inlet port coupled to a refill tube for receiving refill water;

a first outlet port having an entrance and an exit;

a bowl refill tube having a first end coupled to the exit of the first outlet port and a second end adjacent to a toilet tank overflow tube, the bowl refill tube providing a path of fluid communication between the first outlet port and the toilet tank overflow tube;

a second outlet port having an entrance and an exit;

a central flow passageway providing a path of fluid communication between the inlet port and the first and second outlet ports, the entrance of the first outlet port and the entrance of the second outlet port being directly opposite one another in the central flow passageway;

a poppet slidably mounted in the central flow passageway, the poppet having a first raised position obstructing the entrance of the first outlet port and a second lowered position obstructing the entrance of the second outlet port;

an actuating arm coupled to the poppet;

a float member coupled to a rod and movable between a raised position and a lowered position; and a pivoting linkage having a first end coupled to the rod and a second end coupled to the actuating arm, the pivoting linkage translating downward motion of the rod into upward motion of the actuating arm and translating upward motion of the rod into downward motion of the actuating arm;

wherein when water level in a toilet tank in which the diverter valve is mounted falls below a first predetermined level, the float member is in the lowered position and the poppet is in the first raised position obstructing the entrance of the first outlet port and preventing flow of refill water through the first outlet port into the bowl refill tube; and wherein when water level in the toilet tank rises above the first predetermined level, the float member is in the raised position and the poppet is in the second lowered position obstructing the entrance of the second outlet port and permitting flow of refill water through the first outlet port into the bowl refill tube.

2. The diverter valve of claim 1, wherein the poppet comprises a saucer shaped head having a convex upper surface for obstructing the entrance to the first outlet port and a convex lower surface for obstructing the entrance to the second outlet port.

3. The diverter valve of claim 2, wherein the upper and lower surfaces of the poppet head are conical.

4. The diverter valve of claim 1, wherein the inlet port and the first outlet port are integrally formed in an upper housing member that forms an upper wall of the central flow passageway.

5. The diverter valve of claim 4, wherein the second outlet port is integrally formed in a lower housing member that forms a lower wall of the central flow passageway.

6. The diverter valve of claim 5, wherein the lower housing is a portion of a bracket attached to a tower flush valve.

7. The diverter valve of claim 6, wherein the bracket comprises two parallel spaced apart flanges each having an opening therein, and wherein the pivoting linkage comprises opposing pins rotatably engaged within the openings of the spaced apart flanges.

8. The diverter valve of claim 1, wherein the rod is a rail upon which the float member is slidably mounted, the rail comprising a plurality of spaced apart protrusions, the float member further comprising a sliding flange engageable with the spaced apart protrusions to fix the float member in place relative to the rail.

9. A tower flush valve with integral diverter valve, comprising:

a tower frame member mounted in a toilet tank above a drain pipe opening of the toilet tank;

an overflow tube mounted within a housing slidable between a raised position and a lowered position, the overflow tube comprising a flange at its lower end that seals the drain pipe opening when the overflow tube is in the lowered position;

a diverter valve, comprising:

an upper housing forming an upper wall of a central flow passageway, the upper housing comprising an integral inlet port and first outlet port, the inlet port coupled to a refill tube for receiving refill water, the first outlet port having an entrance and an exit;

a bowl refill tube having a first end coupled to the exit of the first outlet port and a second end adjacent to the overflow tube, the bowl refill tube providing a path of fluid communication between the first outlet port and the overflow tube;

a bracket integrally formed with the tower frame member, the bracket forming a lower wall of the central flow passageway and comprising a second outlet port having an entrance and an exit, the central flow passageway providing a path of fluid communication between the inlet port and the first and second outlet ports, the entrance of the first outlet port and the entrance of the second outlet port being directly opposite one another in the central flow passageway;

a poppet slidably mounted in the central flow passageway, the poppet having a first raised position obstructing the entrance of the first outlet port and a second lowered position obstructing the entrance of the second outlet port;

an actuating arm coupled to the poppet;

a float member coupled to a rod, the float member mounted within the tower housing and movable between a raised position and a lowered position; and a pivoting linkage having a first end coupled to the rod and a second end coupled to the actuating arm, the pivoting linkage translating downward motion of the rod into upward motion of the actuating arm and translating upward motion of the rod into downward motion of the actuating arm;

wherein when water level in the toilet tank falls below a first predetermined level, the float member is in the lowered position and the poppet is in the first raised position obstructing the entrance of the first outlet port and preventing flow of refill water through the first outlet port into the bowl refill tube; and wherein when water level in the toilet tank rises above the first predetermined level, the float member is in the raised position and the poppet is in the second lowered position obstructing the entrance of the second outlet port and permitting flow of refill water through the first outlet port into the bowl refill tube.

* * * * *